US009388680B2

(12) United States Patent
Moran

(10) Patent No.: US 9,388,680 B2
(45) **Date of Patent: *Jul. 12, 2016**

(54) SYSTEM FOR OPTIMIZING DRILLING IN REAL TIME

(75) Inventor: David P. Moran, Woodlands, TX (US)

(73) Assignee: Smith International, Inc., Houston, TX (US)

( * ) Notice: Subject to any disclaimer, the term of this patent is extended or adjusted under 35 U.S.C. 154(b) by 1104 days.

This patent is subject to a terminal disclaimer.

(21) Appl. No.: 11/843,929

(22) Filed: Aug. 23, 2007

(65) Prior Publication Data

US 2007/0284147 A1 Dec. 13, 2007

Related U.S. Application Data

(63) Continuation-in-part of application No. 11/556,860, filed on Nov. 6, 2006, now abandoned, which is a continuation of application No. 11/048,516, filed on Feb. 1, 2005, now Pat. No. 7,142,986.

(51) Int. Cl.

| | |
|---|---|
| ***E21B 47/00*** | (2012.01) |
| ***E21B 44/00*** | (2006.01) |
| ***G06F 19/00*** | (2011.01) |
| ***G06G 7/48*** | (2006.01) |
| *E21B 41/00* | (2006.01) |

(52) U.S. Cl.

CPC ..... *E21B 44/00* (2013.01); *E21B 2041/0028* (2013.01)

(58) Field of Classification Search

CPC ..... E21B 47/00; E21B 44/00; G06F 17/60; G06F 19/00

USPC ..... 340/853, 286.04–286.09; 175/39, 40, 175/57; 160/164, 105

See application file for complete search history.

(56) References Cited

U.S. PATENT DOCUMENTS

| | | | | |
|---|---|---|---|---|
| 3,668,307 | A * | 6/1972 | Face et al. | 725/119 |
| 4,041,773 | A * | 8/1977 | Hauldren | E21B 3/00 73/588 |
| 5,715,823 | A * | 2/1998 | Wood et al. | 600/437 |
| 5,730,234 | A | 3/1998 | Putot | |
| 5,812,068 | A | 9/1998 | Wisler et al. | |
| 6,002,985 | A | 12/1999 | Stephenson | |
| 6,012,015 | A | 1/2000 | Tubel | |
| 6,021,377 | A * | 2/2000 | Dubinsky et al. | 702/9 |
| 6,044,325 | A | 3/2000 | Chakravarthy et al. | |
| 6,084,826 | A * | 7/2000 | Leggett, III | 367/82 |
| 6,109,368 | A * | 8/2000 | Goldman | E21B 12/02 175/39 |
| 6,346,595 | B1 | 2/2002 | O'Lenick, Jr. | |

(Continued)

OTHER PUBLICATIONS

U.S. Office Action for related U.S. Appl. No. 11/556,860 dated Sep. 24, 2009. (10 pages).

(Continued)

*Primary Examiner* — Nam V Nguyen

(74) *Attorney, Agent, or Firm* — Osha Liang LLP

(57) ABSTRACT

A method for providing assistance to a drilling site including receiving, by a remote system, an assistance request from a quick-link communication device, wherein the quick-link communication device is located at the drilling location. The method also including obtaining sensor data from the rig based on the assistance request, analyzing, by the remote system, the sensor data to identify a condition of the rig, and providing assistance to the drilling site for the condition of the rig.

16 Claims, 6 Drawing Sheets

(56) References Cited

U.S. PATENT DOCUMENTS

| | | | | |
|---|---|---|---|---|
| 6,377,162 | B1 * | 4/2002 | Delestienne et al. | 340/286.07 |
| 6,408,953 | B1 * | 6/2002 | Goldman | E21B 12/02 175/39 |
| 6,424,919 | B1 | 7/2002 | Moran et al. | |
| 6,519,568 | B1 * | 2/2003 | Harvey et al. | 705/1.1 |
| 6,580,390 | B1 | 6/2003 | Hay | |
| 6,745,153 | B2 | 6/2004 | White et al. | |
| 6,826,483 | B1 | 11/2004 | Anderson et al. | |
| 6,882,271 | B2 * | 4/2005 | Hendrickson | 340/504 |
| 7,032,689 | B2 * | 4/2006 | Goldman | E21B 12/02 175/39 |
| 7,156,579 | B2 * | 1/2007 | Castle | E21B 43/28 405/53 |
| 8,145,462 | B2 * | 3/2012 | Foucault | E21B 44/00 702/6 |
| 2003/0182054 | A1 | 9/2003 | Peterson et al. | |
| 2004/0010366 | A1 | 1/2004 | Videtich | |
| 2004/0125764 | A1 | 7/2004 | Piwowarski et al. | |
| 2004/0256152 | A1 | 12/2004 | Dashevskiy et al. | |
| 2006/0122925 | A1 * | 6/2006 | Wesby | 705/35 |

OTHER PUBLICATIONS

U.S. Final Office Action for related U.S. Appl. No. 11/556,860, dated Nov. 4, 2008, (10 pages).

* cited by examiner

SYSTEM FOR OPTIMIZING DRILLING IN REAL TIME

CROSS-REFERENCE TO RELATED APPLICATIONS

This application is a continuation-in-part of U.S. patent application Ser. No. 11/556,860, filed Nov. 6, 2006, which is a continuation of U.S. patent application Ser. No. 11/048,516, filed Feb. 1, 2005, and claims the benefit, pursuant to 35 U.S.C. §120 of that application. These applications are expressly incorporated by reference in their entirety.

BACKGROUND OF INVENTION

1. Field of the Invention

The present invention is related generally to the field of rotary wellbore drilling. More specifically, the invention relates to methods for communicating with a drilling site to provide assistance to the drilling site, such as to optimize drilling performance.

2. Background Art

Wellbore drilling, which is used, for example, in petroleum exploration and production, includes rotating a drill bit while applying axial force to the drill bit. The rotation and the axial force are typically provided by equipment at the surface that includes a drilling "rig." The rig includes various devices to lift, rotate, and control segments of drill pipe, which ultimately connect the drill bit to the equipment on the rig. The drill pipe provides a hydraulic passage through which drilling fluid is pumped. The drilling fluid discharges through selected-size orifices in the bit ("jets") for the purposes of cooling the drill bit and lifting rock cuttings out of the wellbore as it is being drilled.

The speed and economy with which a wellbore is drilled, as well as the quality of the hole drilled, depend on a number of factors. These factors include, among others, the mechanical properties of the rocks which are drilled, the diameter and type of the drill bit used, the flow rate of the drilling fluid, and the rotary speed and axial force applied to the drill bit. It is generally the case that for any particular mechanical properties of rocks, a rate at which the drill bit penetrates the rock ("ROP") corresponds to the amount of axial force on and the rotary speed of the drill bit. The rate at which the drill bit wears out is generally related to the ROP.

In the process of wellbore drilling, certain conditions may arise from which further consideration of the drilling site is required. For example, emergency situations may occur, portions of the drilling site may fail, or optimal drilling parameters may be desired. When emergency situations occur, the personnel at the drilling site may identify the appropriate emergency service and contact the emergency service via mobile or satellite phone. In the case of failure, a technician at the drilling site or an engineer at the drilling site may attempt to identify the source of the failure and correct the failure.

With regards to optimizing drilling parameters, various methods have been developed to optimize various drilling parameters to achieve various desirable results.

Prior art methods for optimizing values for drilling parameters have focused on rock compressive strength. For example, U.S. Pat. No. 6,346,595, issued to Civolani, et al. ("the '595 patent"), and assigned to the assignee of the present invention, discloses a method of selecting a drill bit design parameter based on the compressive strength of the formation. The compressive strength of the formation may be directly measured by an indentation test performed on drill cuttings in the drilling fluid returns. The method may also be applied to determine the likely optimal drilling parameters such as hydraulic requirements, gauge protection, weight on bit ("WOB"), and the bit rotation rate. The '595 patent is hereby incorporated by reference in its entirety.

U.S. Pat. No. 6,424,919, issued to Moran, et al. ("the '919 patent"), and assigned to the assignee of the present invention, discloses a method of selecting a drill bit design parameter by inputting at least one property of a formation to be drilled into a trained Artificial Neural Network ("ANN"). The '919 patent also discloses that a trained ANN may be used to determine optimal drilling operating parameters for a selected drill bit design in a formation having particular properties. The ANN may be trained using data obtained from laboratory experimentation or from existing wells that have been drilled near the present well, such as an offset well. The '919 patent is hereby incorporated by reference in its entirety.

ANNs are a relatively new data processing mechanism. ANNs emulate the neuron interconnection architecture of the human brain to mimic the process of human thought. By using empirical pattern recognition, ANNs have been applied in many areas to provide sophisticated data processing solutions to complex and dynamic problems (i.e., classification, diagnosis, decision making, prediction, voice recognition, military target identification, to name a few).

Similar to the human brain's problem solving process, ANNs use information gained from previous experience and apply that information to new problems and/or situations. The ANN uses a "training experience" (i.e., the data set) to build a system of neural interconnects and weighted links between an input layer (i.e., independent variable), a hidden layer of neural interconnects, and an output layer (i.e., the dependant variables or the results). No existing model or known algorithmic relationship between these variables is required, but such relationships may be used to train the ANN. An initial determination for the output variables in the training exercise is compared with the actual values in a training data set. Differences are back-propagated through the ANN to adjust the weighting of the various neural interconnects, until the differences are reduced to the user's error specification. Due largely to the flexibility of the learning algorithm, non-linear dependencies between the input and output layers can be "learned" from experience.

Several references disclose various methods for using ANNs to solve various drilling, production, and formation evaluation problems. These references include U.S. Pat. No. 6,044,325 issued to Chakravarthy, et al., U.S. Pat. No. 6,002,985 issued to Stephenson, et al., U.S. Pat. No. 6,021,377 issued to Dubinsky, et al., U.S. Pat. No. 5,730,234 issued to Putot, U.S. Pat. No. 6,012,015 issued to Tubel, and U.S. Pat. No. 5,812,068 issued to Wisler, et al.

SUMMARY OF INVENTION

In one aspect, the disclosure relates to a method for providing assistance to a drilling site including receiving, by a remote system, an assistance request from a quick-link communication device, wherein the quick-link communication device is located at the drilling location. The method also includes obtaining sensor data from the rig based on the assistance request, analyzing, by the remote system, the sensor data to identify a condition of the rig, and providing assistance to the drilling site for the condition of the rig.

In another aspect, the disclosure relates to a system for providing assistance to a drilling site including a quick-link communication device located at the drilling site of a rig. Additionally, the system includes a remote system configured to receive an assistance request from the quick-link communication device, obtain sensor data from the rig based on the assistance request, analyze the sensor data to identify a condition of the rig, and provide assistance to the drilling site for the condition of the rig.

In another aspect, the disclosure relates to a computer readable medium including program code embodied therein for causing a computer system to receive, by a remote system, an assistance request from a quick-link communication device, wherein the quick-link communication device is located at the drilling site of a rig. Additionally, the program code causes the system to obtain sensor data from the rig based on the assistance request, analyze, by the remote system, the sensor data to identify a condition of the rig, and provide assistance to the drilling site for the condition of the rig.

Other aspects of the invention will be apparent from the following description and the appended claims.

DETAILED DESCRIPTION

Figure 1:
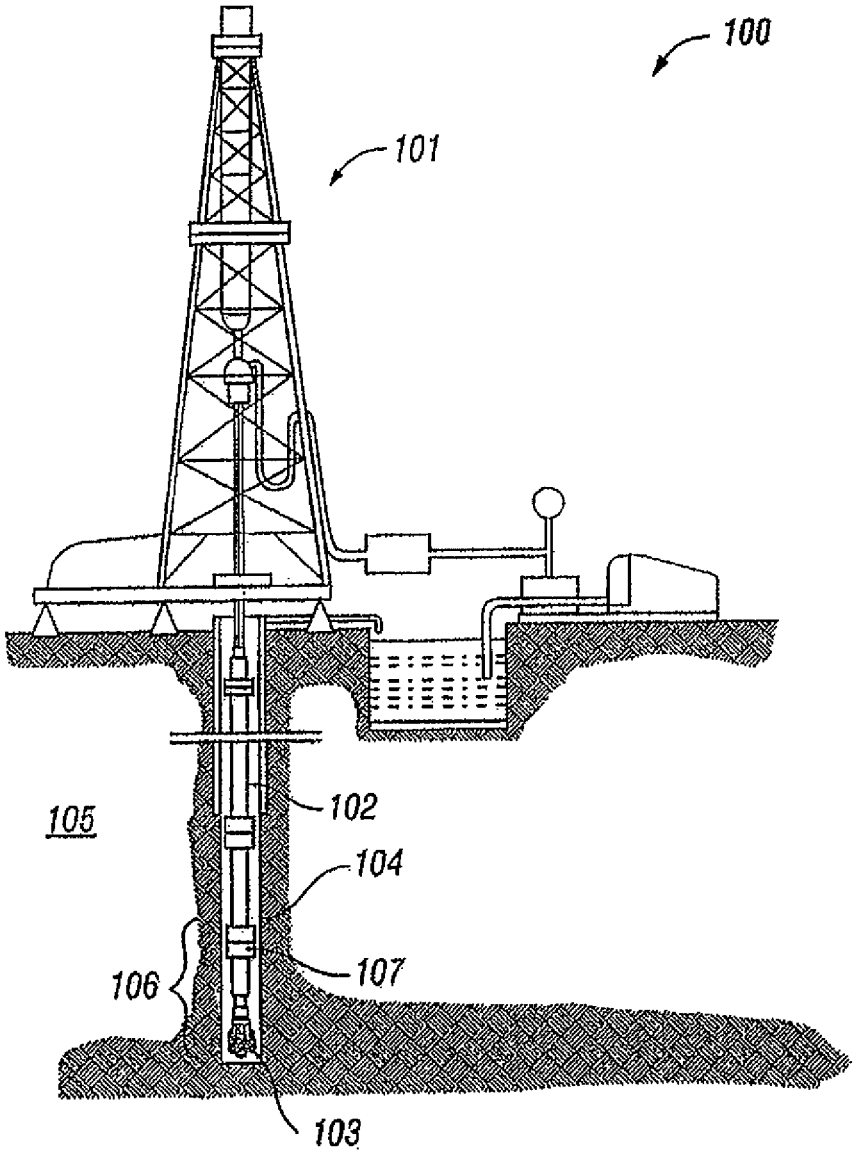
FIG. 1 (PRIOR ART)
FIG. 1 shows a typical drilling system.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

In one or more embodiments, the present invention relates to a method for providing assistance to a drilling site. Assistance is requested using a quick-link communication device.

The following section contains definitions of several specific terms used in this disclosure. These definitions are intended to clarify the meaning of the terms used herein. It is believed that the terms are used in a manner consistent with their ordinary meaning, but the definitions are nonetheless specified here for clarity.

The term "real-time" is defined in the McGraw-Hill Dictionary of Scientific and Technical Terms (6th ed., 2003) on page 1758. "Real-time" pertains to a data-processing system that controls an ongoing process and delivers its outputs (or controls its inputs) not later than the time when these are needed for effective control. In this disclosure, "in real-time" means that optimized drilling parameters for an upcoming segment of formation to be drilled are determined and returned to a data store at a time not later than when the drill bit drills that segment. The information is available when it is needed. This enables a driller or automated drilling system to control the drilling process in accordance with the optimized parameters. Thus, "real-time" is not intended to require that the process is "instantaneous."

The term "next segment" generally refers to a future portion of a formation ahead of the drill bit's current position that is to be drilled by the drill bit. A segment does not have a specified length. In one or more embodiments, the "next segment" comprises a change in formation lithology, porosity, compressive strength, shear strength, rock abrasiveness, the fluid in the pore spaces in the rock, or any other mechanical property of the rock and its contents that may require a change in drilling parameters to achieve an optimal situation. The next segment may extend to another change in formation lithology. In other embodiments, a segment may be broken into a selected size based on a size that is practical for use in optimizing drilling parameters.

The word "remote" is defined in The Chamber's Dictionary (9th ed., 2003) on page 1282. It is an adjective meaning "far removed in place, . . . widely separated." In relation to computers, The Chamber's Dictionary defines "remote" as "located separately from the main processor but having a communication link with it." In this disclosure, "remote" means at separate location (e.g., removed from the drilling site), but having a communication link (e.g., satellite, internet, etc.). For example, a "remote data store" may be at a different location from a drilling site. In one example, a "remote data store" is located at the location where the drilling parameters are optimized. In addition, a "remote data store" may be located at the drilling site, but remote from the drilling parameter optimization. In many embodiments, however, a "remote data store" is located remote from both the drilling site and the location where the drilling parameter optimization is performed.

The "current well" is the well for which a drilling parameter optimization method is being performed. The current well is set apart from an offset well or other types of wells that may be drilled in the same area. "Current well data" refers to data that is related to the current well. The data relating to the current well may have been taken at any time.

The "sensor data" is any type of data which may be collected from virtually any type of sensor. For example, sensor data may include well data, weather data, seismic activity, data from fire detectors, data from emergency medical equipment (e.g., heart rate monitor, etc.).

The term "rig failure" may include drill bit stop functioning properly, structural damage, waste management equipment failure, infrastructural damage to the rig, or any other portion of the drilling site sustaining damage.

In this disclosure, "previously acquired data" refers to at least (1) any data related to a well drilled in the same general area as the current well, (2) any data related to a well drilled in a geologically similar area, or (3) seismic or other survey data. "Previously acquired data" may be any data that may aid the predictive process described herein. Typically, "previously acquired data" is data obtained from the drilling of an "offset well" in the same area. Offset wells are drilled to learn more information about the subterranean formations. In addition, data from previously or concurrently drilled other well bores in the same area may be used as previously acquired data. Finally, data from wells drilled in geologically similar areas may comprise part of the previously acquired data.

A "drilling parameter" is any parameter that affects the way in which the well is being drilled. For example, the WOB is an important parameter affecting the drilling well. Other drilling parameters include the torque-on-bit ("TOB"), the rotary speed of the drill bit ("RPM"), and mud flow rate. There are numerous other drilling parameters, as is known in the art, and the term is meant to include any such parameter.

The term "optimized drilling parameters" refers to values for drilling parameters that have been optimized for a given set of drilling priorities. "Optimized" does not necessarily mean the best possible drilling parameters because an optimization method may account for one or more drilling priorities. The optimized drilling parameters may be a result of these priorities, and may not represent the drilling parameters that will result in the most economical drilling or the longest bit life.

An "external service" is a service that is not solely used by the drilling site. For example, an external service may be an offsite emergency service (e.g., fire, medical, etc.), contracted experts, equipment manufacture, or any other such service.

The present invention generally relates to methods for providing assistance to a drilling site. An assistance request (i.e., a request for assistance) is received by a remote system using a quick-link communication device (discussed below). The assistance request may be a request for general information, failure recovery, optimizing drilling parameters, etc. Upon the receipt of an assistance request, sensor data from the rig may be obtained and analyzed to determine the condition of the rig. Based on the condition, assistance may be provided.

For example, when the assistance request is for optimizing drilling parameters, in some cases in real-time, an optimization method may be performed by obtaining sensor data corresponding to current well data from a remote data store. In this example, once the method or methods are complete, the optimized drilling parameters may be uploaded to the data store for use.

The sensor data that may be used may be collected during the drilling process. Such data may relate to current drilling parameters, formation properties, or any other data that may be collected during the drilling process. The following is a description of some of the data that may be collected, and how it related to the drilling an optimization processes.

FIG. 1 shows a typical drilling system 100. The drilling system 100 includes a rig 101 used to suspend a drill string 102 into a borehole 104. A drill bit 103 at the lower end of the drill string 102 is used to drill through Earth formations 105. Sensors and other drilling tools (e.g., drilling tool 107) may be included in a bottom hole assembly 106 ("BHA") near the bottom of the drill string 102. The drilling system 100 shown in FIG. 1 is a land-based drilling system. Other drilling systems, such as deep water drilling systems, are located on floating platforms. The difference is not germane to the present invention, and no distinction is made.

While drilling, it is desirable to gather as much data about the drilling process and about the formations through which the borehole 104 penetrates. The following description provides examples of the types of sensors that are used and the data that is collected. It is noted that in practice, it is impractical to use all of the sensors described below due to space and time constraints. In addition, the following description is not exhaustive. Other types of sensors are known in the art that may be used in connection with a drilling process and the invention is not limited to the examples provided herein.

The first type of data that is collected may be classified as near instantaneous measurements, often called "rig sensed data" because it is sensed on the rig. These include the WOB and the TOB, as measured at the surface. Other rig sensed data include the RPM, the casing pressure, the depth of the drill bit, and the drill bit type. In addition, measurements of the drilling fluid ("mud") are also taken at the surface. For example, the initial mud condition, the mud flow rate, and the pumping pressure, among others. All of these data may be collected on the rig 101 at the surface, and they represent the drilling conditions at the time the data are available.

Other measurements are taken while drilling by instruments and sensors in the BHA 106. These measurements and the resulting data are typically provided by an oilfield services vendor that specializes in making downhole measurements while drilling. The invention, however, is not limited by the party that makes the measurements or provides the data.

As described with reference to FIG. 1, a drill string 102 typically includes a BHA 106 that includes a drill bit 103 and a number of downhole tools (e.g., tool 107 in FIG. 1). Downhole tools may include various sensors for measuring the properties related to the formation and its contents, as well as properties related to the borehole conditions and the drill bit. In general, "logging-while-drilling" ("LWD") refers to measurements related to the formation and its contents. "Measurement-while-drilling" ("MWD"), on the other hand, refers to measurements related to the borehole and the drill bit. The distinction is not germane to the present invention, and any reference to one should not be interpreted to exclude the other.

LWD sensors located in a BHA 106 may include, for example, one or more of a gamma ray tool, a resistivity tool, an NMR tool, a sonic tool, a formation sampling tool, a neutron tool, and electrical tools. Such tools are used to measure properties of the formation and its contents, such as, the formation porosity, density, lithology, dielectric constant, formation layer interfaces, as well as the type, pressure, and permeability of the fluid in the formation.

One or more MWD sensors may also be located in a BHA 106. MWD sensors may measure the loads acting on the drill string, such as WOB, TOB, and bending moments. It is also desirable to measure the axial, lateral, and torsional vibrations in the drill string. Other MWD sensors may measure the azimuth and inclination of the drill bit, the temperature and pressure of the fluids in the borehole, as well as properties of the drill bit such as bearing temperature and grease pressure.

The data collected by LWD/MWD tools is often relayed to the surface before being used. In some cases, the data is simply stored in a memory in the tool and retrieved when the tool it brought back to the surface. In other cases, LWD/MWD data may be transmitted to the surface using known telemetry methods.

Telemetry between the BHA and the surface, such as mud-pulse telemetry, is typically slow and only enables the transmission of selected information. Because of the slow telemetry rate, the data from LWD/MWD may not be available at the surface for several minutes after the data has been collected. In addition, the sensors in a typical BHA 106 are located behind the drill bit, in some cases by as much as fifty feet. Thus, the data received at the surface may be slightly delayed due to the telemetry rate that the position of the sensors in the BHA.

Other measurements are made based on lagged events. For example, drill cuttings in the return mud are typically analyzed to gain more information about the formation that has been drilled. During the drilling process, the drill cuttings are transported to the surface in the mud flow in through the annulus between the drill string 102 and the borehole 104. In a deep well, for example, the drill bit 103 may drill an additional 50 to 100 feet while a particular fragment of drill cuttings travels to the surface. Thus, the drill bit continues to advance an additional distance, while the drilled cuttings from the depth position of interest are transported to the surface in the mud circulation system. The data is lagged by at least the time to circulate the cuttings to surface.

Analysis of the drill cuttings and the return mud provides additional information about the formation and its contents. For example, the formation lithology, compressive strength, shear strength, abrasiveness, and conductivity may be measured. Measurements of the return mud temperature, density, and gas content may also yield data related to the formation and its contents.

In addition to the aforementioned sensors, sensor data that is not directly related to drilling parameters at the drilling site, such as sensor data corresponding to environmental conditions, constructional stability of the rig, etc., may be collected from sensors at the drilling site. For example, the sensors may include thermometers, pressure gauges, air speed indicators, chemical detectors, etc.

Figure 2:
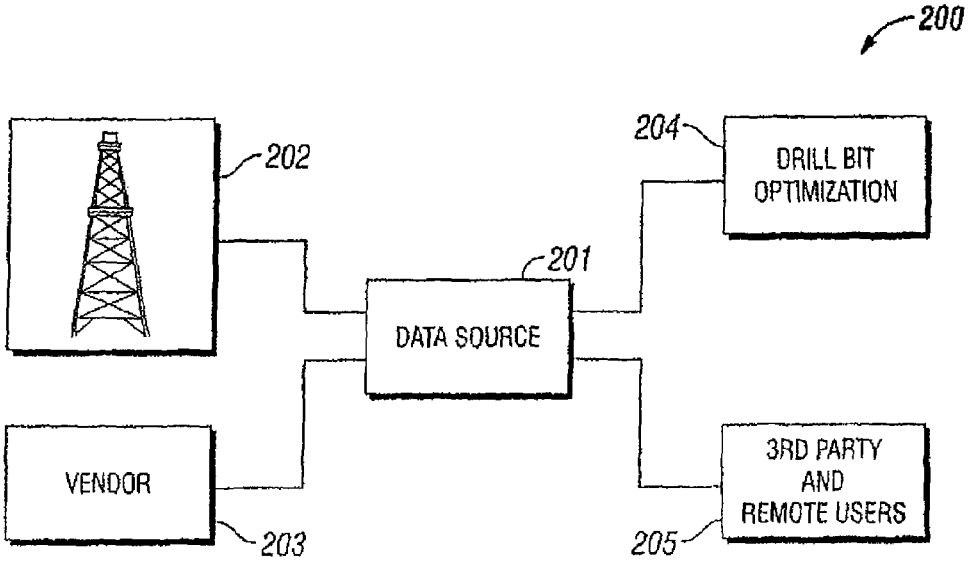
FIG. 2 shows a schematic of communication connections relating to a drilling process in accordance with at least one embodiment of the invention.

FIG. 2 shows a schematic of drilling communications system 200. The drilling system (e.g., drilling system 100 in FIG. 1), including the drilling rig and other equipment at the drilling site 202, is connected to a remote data store 201. As data is collected at the drilling site 202, the data is transmitted to the data store 201.

The remote data store 201 may be any database for storing data. For example, any commercially available database may be used. In addition, a database may be developed for the particular purpose of storing drilling data without departing from the scope of the invention. In one embodiment, the remote data store uses a WITSML (Wellsite Information Transfer Standard) data transfer standard. Other transfer standards may also be used without departing from the scope of the invention.

The drilling site 202 may be connected to the data store 201 via an internet connection. Such a connection enables the data store 201 to be in a location remote from the drilling site 202. The data store 201 is preferably located on a secure server to prevent unauthorized access. Other types of communication connections may be used without departing from the scope of the invention. Further, the data may be transmitted to the data store 201 directly, such as via the Internet and a database server. Alternatively, the data may be transmitted indirectly, such as through an intermediary (e.g., a remote system (discussed below)). For example, the intermediary may include functionality to process the data before populating the data store 201.

Other party connections to the data store 201 may include an oilfield services vendor(s) 203, a drilling optimization service 204, and third party and remote users 205. In some embodiments, each of the different parties (202, 203, 204, 205) that have access to the data store 201 are in different locations. In practice, oilfield service vendors 203 are typically located at the drilling site 202, but they are shown separately because vendors 203 represent a separate party having access to the data store 201. In addition, the invention does not preclude a vendor 203 from transmitting the LWD/MWD measurement data to a separate site for analysis before the data is uploaded to the data store 201.

In addition to having a data store 201 located on a secure server, in some embodiments, each of the parties connected to the data store 201 has access to view and update only specific portions of the data in the data store 201. For example, a vendor 203 may be restricted such that they cannot upload data related to drill cutting analysis, a measurement which is typically not performed by the vendor.

As measurement data becomes available, it may be uploaded to the data store 201. The data may be correlated to the particular position in the wellbore to which the data relate, a particular time stamp when the measurement was taken, or both. The normal rig sensed data (e.g., WOB, TOB, RPM, etc.) will generally relate to the drill bit position in the wellbore that is presently being drilled. As this data is uploaded to the data store 201, it will typically be correlated to the position of the drill bit when the data was recorded or measured.

Vendor data (e.g., data from LWD/MWD instruments), as discussed above, may be slightly delayed. Because of the position of the sensors relative to the drill bit and the delay in the telemetry process, vendor data may not relate to the current position of the drill bit when the data becomes available. Still, the delayed data will typically be correlated to a specific position in the wellbore when it was measured and then is uploaded to the data store 201. It is noted that the particular wellbore position to which vendor data are correlated may be many feet behind the current drill bit position when the data becomes available.

In some embodiments, the vendor data may be used to verify or update rig sensed data that has been previously recorded. For example, one type of MWD sensor that is often included in a BHA is a load cell or a load sensor. Such sensors measure the loads, such as WOB and TOB, which are acting on the drill string near the bottom of the borehole. Because data from near the drill bit will more closely represent the actual drilling conditions, the vendor data may be used to update or verify similar measurements made on the rig. One possible cause for a discrepancy in such data is that the drill string may encounter friction against the borehole wall. When this occurs, the WOB and TOB measured at the surface will tend to be higher than the actual WOB and TOB experienced at the drill bit.

The process of drilling a well typically includes several "trips" of the drill string. A "trip" is when the entire drill string is removed from the well to, for example, replace the drill bit or other equipment in the BHA. When the drill string is tripped, it is common practice to lower one or more "wireline" tools into the well to investigate the formations that have already been drilled. Typically, wireline tool measurements are performed by an oilfield services vendor.

Wireline tools enable the use of sensors and instruments that may not have been included in the BHA. In addition, the wire that is used to lower the tool into the well may be used for data communications at much faster rates that are possible with telemetry methods used while drilling. Data obtained through the use of wireline tools may be uploaded to the data store so that the data may be used in future optimization methods performed for the current well, once drilling recommences.

As was mentioned above, it is often the case that some of the LWD/MWD data that is collected may not be transmitted to the surface due to constraints in the telemetry system. Nonetheless, it is common practice to store the data in a memory in the downhole tool. When the BHA is removed from the well during a trip of the drill string, a surface computer may be connected to the BHA sensors and instruments to obtain all of the data that was gathered. As with wireline data, this newly collected LWD/MWD data may be uploaded to the data store for use in the continuous or future optimization methods for the current well.

Similar to vendor data, data from lagged events may also be correlated to the position in the wellbore to which the data relate. Because the data is lagged, the correlated position will be a position many feet above the current position of the drill bit when the data becomes available and is uploaded to the data store 201. For example, data gained through the analysis of drill cuttings may be correlated to the position in the wellbore where the cuttings were produced. By the time such data becomes available, the drill bit may have drilled many additional feet.

As with certain types of vendor data, some lagged data may be used to update or verify previously obtained data. For example, analysis of drill cuttings may yield data related to the porosity or lithology of the formation. Such data may be used to update or verify vendor data that is related to the same properties. In addition, some types of downhole measurements are dependent of two or more properties. Narrowing the possible values for porosity, for example, may yield better results for other formation properties. The newly available data, as well as data updated from lagged events, may then be used in future optimization methods.

Figure 3:
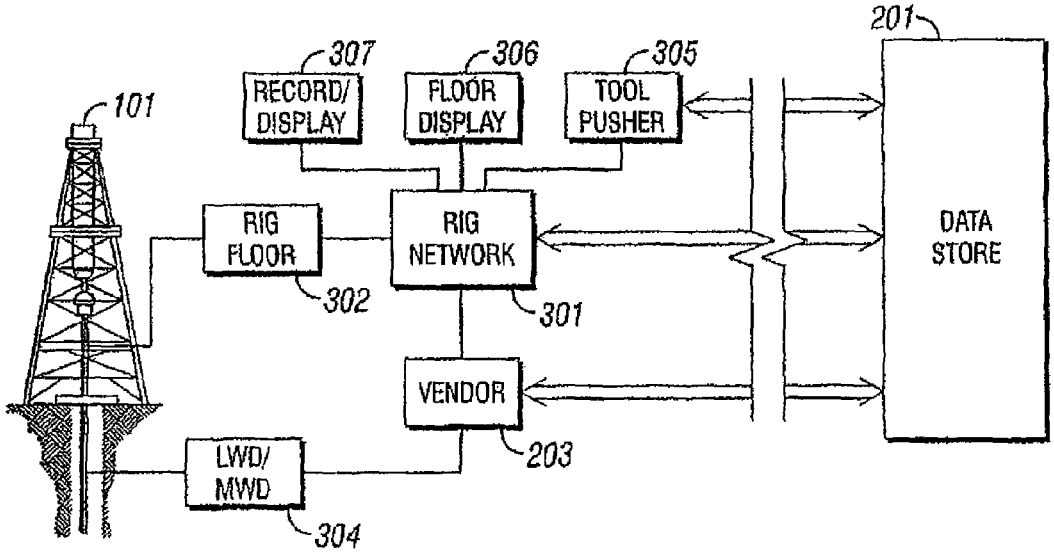
FIG. 3 shows a schematic of a rig communications network in accordance with at least one embodiment of the invention.

FIG. 3 shows a schematic of one example of communications at a drilling site. A rig network 301 is generally used to connect the components on the rig 101 or at the rig site so that communication is possible. For example, most of the rig sensed data and lagged data are measured at the rig floor, represented generally at 302. The data collected at the rig floor 302 may be transmitted, through the rig network 301, to locations where the data may be useful. For example, the data may be recorded on chart recorded and printers or plotters, represented generally at 307. The data may be transmitted to a rig floor display, shown generally at 306, or to a display for the tool pusher (Rig Manager) of company man (Operator Representative), shown generally at 305.

In addition, a vendor, shown generally at 203 may collect data, such as LWD/MWD data and wireline data, from downhole tools, shown generally at 304. Such data may then be communicated, through the rig network 301, to those locations where the data may be useful or needed.

In the example shown in FIG. 3, the rig network 301 is connected to a remote data store 201. The remote data store 201 may be located apart from the drilling site. For example, the rig network may be connected to the data store 201 through a secure internet connection. In addition to the rig network 301, other users may also be connected to the data store 201. For example, as shown in FIG. 3, the tool pusher or company man 305 may be connected to the data store so that data may be directly queried from the data store 201. Also, a vendor 203 may be connected to the data store 201 so that vendor data may be uploaded to the data store 201 as soon as it becomes available.

The schematic in FIG. 3 is shown only as an example. Other configurations may be used without departing from the scope of the invention.

Figure 4:
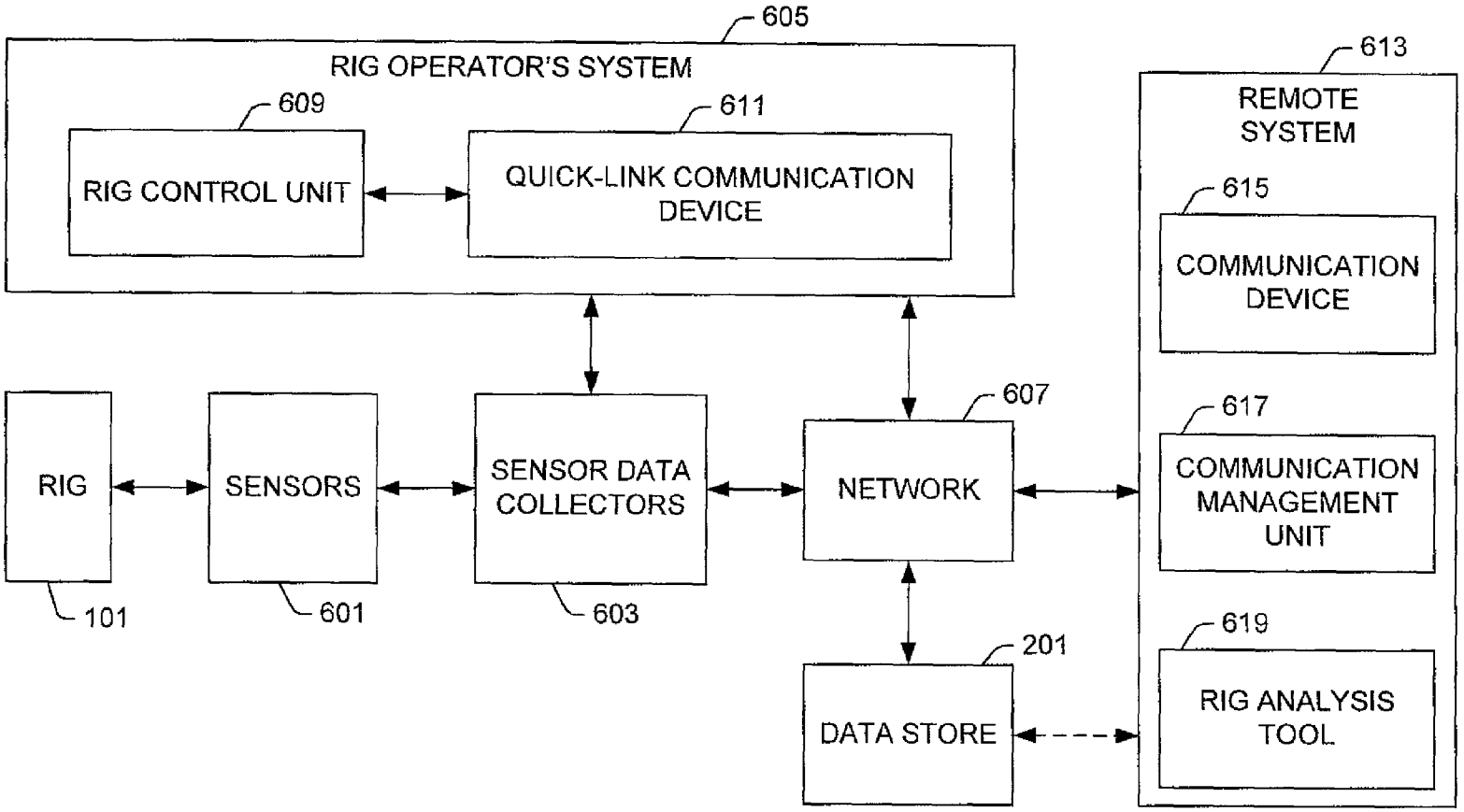
FIG. 4 shows a schematic diagram of a communication system in accordance with at least one embodiment of the invention.

FIG. 4 shows a schematic diagram of a communication system for providing assistance to the drilling site in accordance with at least one embodiment of the invention. The drilling site includes the rig 101, sensors 601, sensor data collectors 603, and a rig operators system 605. The drilling site may or may not also include the data store 201 and a portion of the network 607. The sensors 601 may be any of the sensors discussed above, such as the sensors for collecting data from the rig floor, LWD or MWD (e.g., 304 in FIG. 3), environmental sensors, etc.

The sensors 601 are connected to sensor data collectors 603 in accordance with one or more embodiments of the invention. The sensor data collectors 603 include functionality to obtain sensor data from a sensor. For example, a sensor data collector may be a vendor. In another example, a sensor data collector 603 may be a computing device that is a part of the sensor 601. A sensor data collector 603 includes functionality to transmit sensor data to the data store 201 and the rig operator's system 605. Further, the sensor data collector 603 may include functionality to receive a request for sensor data and obtain sensor data from the sensor 601 on demand.

The sensor data collector 603 is connected to a rig operator's system 605. A rig operator's system 605 is a control system for a rig operator to manage the operations of the drilling site. The rig operator may be an onsite engineer, a technician, a company man, a tool pusher, or any other individual associated with the drilling site. The rig operator's system 605 may be located virtually anywhere at the drilling site. Further, components of the rig operator's system 605 may be distributed throughout the drilling site.

The rig operator's system 605 includes a quick-link communication device 611 and a rig control unit 609. A quick-link communication device 611 is any type of device that provides access to a remote system 613 with minimal input from the rig operator. In at least one embodiment of the invention, the quick-link communication device 611 is a dedicated communication device for connecting to the remote system 613. Specifically, the quick-link communication device 611 may be configured to allow connections only to the remote system 613. One skilled in the art will appreciate that the quick-link communication device 611 may be alternatively configured to allow connections to multiple different devices, such as, for example, emergency services, drilling optimization systems, etc., without departing from the scope of the invention.

The quick-link communication device 611 may include, for example, a button, a microphone, and a speaker. A button is a device used to receive single value input. Specifically, a button is either selected or not selected. The button may or may not require compression to be selected. For example, the button may include a sensor which detects heat. In general, the quick-link communication device 611 includes only a single button. Specifically, in order to enable the communication with the remote system 613, the rig operator may only be required to select the single button. However, in alternative embodiments, the quick-link communication device may have multiple buttons for different levels or kinds of service or for different systems.

As an alternative to a button, the quick-link communication device 611 may include only a microphone and programming logic in hardware or software which includes functionality to detect a keyword or phrase, such as "assistance request." In such scenario, the quick-link communication device 611 may include functionality to continuously monitor an area around the microphone for the audio input corresponding to the keyword or phrase.

When the quick-link communication device 611 receives a selection of the button or the key phrase is spoken, the quick-link communication device 611 requests connection with the remote system 613. Specifically, hardware and/or software logic on the quick-link communication device 611 includes functionality to send an assistance request to the remote system 613 in order to open a channel of communication. As illustrated, the request may be sent to the remote system 613 via a network 607.

While the above discusses the use of a button or programming logic, other selection mechanisms may be used without departing from the scope of the invention. Furthermore, as an alternative to or in addition to a microphone and speaker, the quick link communication device 611 may include a display, such as a monitor or other type of visual output and/or input device (e.g., a track screen).

In addition to the quick-link communication device 611, the rig operator's system 605 includes a rig control unit 609. A rig control unit 609 is a system that allows the rig operator to interact with sensor data and the rig 101. For example, the rig control unit 609 may include the record/display shown in FIG. 3, a floor display, and/or a computer system for adjusting operations on the rig. For example, using the rig control unit 609, a rig operator may change drilling parameters (e.g., WOB, TOB), drilling fluid flow rates, and drilling fluid parameters. Additionally, the drilling operator may initiate a trip of the drill string and/or adjust components of the drill string assembly using the rig control unit 609. The rig control unit 609 may further include functionality to trigger the quick-link communication device 611 to connect to the remote system 613. For example, when the rig control unit 609 detects a failure or emergency with the rig 101, the rig control unit 609 may trigger, such as via a signal, the quick-link communication device 611 to contact the remote system 613 with an assistance request that includes information about the emergency or failure.

Continuing with FIG. 4, in at least one embodiment of the invention, the drilling site is connected to a remote system 613 via a network 607. The remote system 613 includes functionality to provide general information and assistance to the drilling site. In one or more embodiments of the invention, the remote system 613 includes a communication device 615, communication management unit 617, and a rig analysis tool 619.

A communication device 615 is any type of device used for communication, such as a computer system, telephone, etc. The communication device 615 may be portable or stationary. Typically, the communication device 615 enables an engineer, technical expert, or other assistance provider to communicate with the drilling site. In at least one embodiment of the invention, the communication device 615 allows for the assistance provider to interact with the rig control unit 609, the sensor data, and/or the sensor data collectors 603. For example, the communication device 615 may include a display that is connected to the data store 201, the sensor data collectors 603, and the rig control unit 609.

In one or more embodiments of the invention, a communication management unit 617 manages communication to the remote system 613. The communication management unit 617 may include functionality to create an ordering of the communications to the remote system 613 according to priority, register communication devices 615 to receive assistance requests, and provide a connection to an appropriate communication device 615 according to the priority and the registration of the communication device 615. Specifically, the communication management unit 617 provides an access into the remote system 613. The communication management unit 617 may also include a notification system. A notification system allows users to be notified of the assistance request. Prior to being notified, the users register with the notification system. For example, during the registration, a user may request that upon receipt of an assistance request for a malfunction of the rig 101, the user is notified via email, text message, etc. The user may also use the notification system to request a log of communications with the quick-link communication device 611.

While FIG. 4 shows a system for an assistance provider to be an individual, alternatively, the assistance provider may be automated. In such scenario, the communication device, the communication management unit, and assistance provider may be replaced by an automated help system. Specifically, functionality provided by the communication device, the communication management unit, and assistance provider may be performed by the automated help system.

Continuing with FIG. 4, the remote system 613 may also include a rig analysis tool 619. The rig analysis tool 619 may include the drilling optimization service, and third party and remote users. The rig analysis tool 619 may also include a statistical service. The statistical service may include functionality to identify the likely source of failure in the rig based on the rig condition and the assistance request. For example, the statistical service may include functionality to use historical statistical sensor data from the rig 101 and other rigs to identify a potential cause of failure of the rig 101. The statistical service may further identify, based on the assistance request, the type of current sensor data required to perform the analysis, and request such required sensor data. The historical sensor data used by the statistical service may be raw data or processed data, which is stored in the data store 201.

The data store 201 may be local or remote to the remote system 613. Thus, the data store may be directly connected to or a part of the remote system. Further, while FIG. 4 shows the data store as connected to the network 607, in other embodiments, access to the data store 201 may be limited to access only through the remote system 613.

As shown in FIG. 4, components of the communication system may use the network 607 for communication. The network 607 may be any type of network known in the art, such as a local area network, wide area network, or a combination thereof. Further, the network 607 may use cables, satellites, wireless signals, fiber optic cable, etc. The network 607 shown in FIG. 4 may also encompass multiple networks. Each of the multiple networks may be dependent on the components which the network connects. For example, a quick-link communication device 611 may communicate with the remote system 613 via a telephone network or satellite connection. In contrast, the sensor data collectors 603 may communicate with the data store 201 via the Internet. Further, while FIG. 4 shows a direct connection between the sensor data collectors 603 and the rig operator system 605, a local area network may be used. In such a scenario, the local area network may be part of network 607.

FIGS. 5-8 show methods in accordance with at least one embodiment of the invention. While the various steps in this flowchart are presented and described sequentially, one of ordinary skill will appreciate that some or all of the steps may be executed in different orders and some or all of the steps may be executed in parallel.

Figure 5:
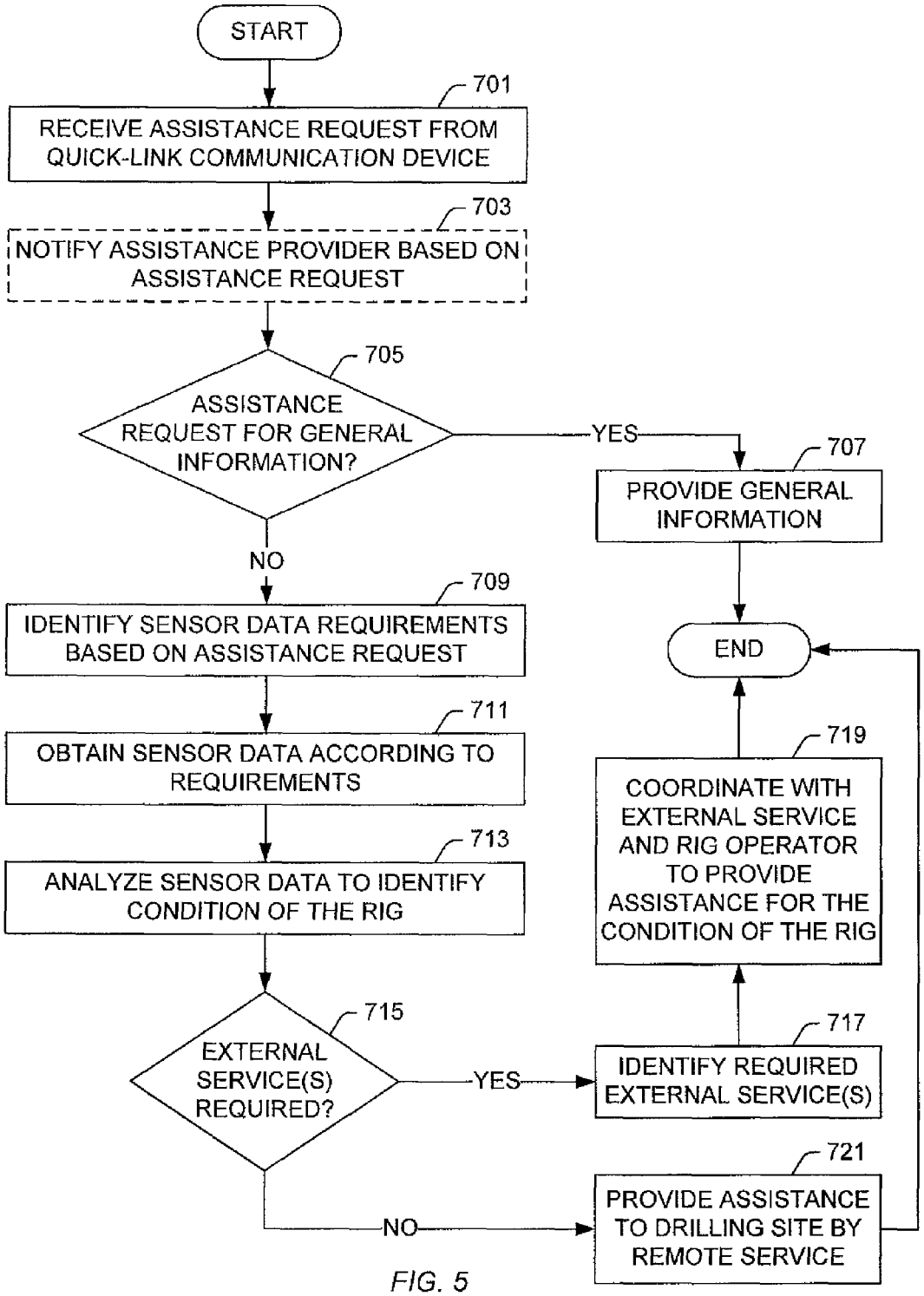
FIG. 5 shows a method in accordance with at least one embodiment of the invention.

FIG. 5 shows a method of providing assistance to a drilling site in accordance with at least one embodiment of the invention. Initially, an assistance request is received from the quick-link communication device, at step 701. The quick-link communication device may instigate the request, for example, upon the selection of the selection mechanism from the rig operator or upon the command of the rig control unit. When the selection mechanism is selected, the quick-link communication device initiates communication with the remote system using communication methods known in the art and communication methods discussed above. In at least one embodiment of the invention, the initial communication may also include an assistance request with the severity of the assistance required. For example, in the case of an emergency, the assistance request may specify that the severity is higher than an assistance request requesting optimization parameters.

Upon receipt of the assistance request, an assistance provider may be notified based on the assistance request, at step 703. For example, the assistance request may trigger the notification tool to contact users who have registered with the notification tool. Further, the communication manager may determine the type of assistance request and route the assistance request accordingly. For example, if the assistance request is regarding a failure in the BHA, the communication manager may access a list of assistance providers to identify an assistance provider that is available to address the failure.

When an automated help system is used, then assistance may be served by the automated help system rather than using an assistance provider. Furthermore, in at least one embodiment of the invention, the automated help system may provide a mechanism to be directed to an assistance provider based on the request of the rig operated or a determination as to the severity of the assistance request.

A determination is made as to whether the assistance request is for general information, at step 705. General information includes information that is not necessarily dependent on sensor data. For example, general information may include information about weather conditions, seismic activity, news, development plans for the drilling site, etc. If the assistance request is for general information, then general information is provided to the drilling site, at step 707.

Alternatively, the assistance request may require the use of sensor data to provide assistance. In such a scenario, the sensor data requirements are identified based on the assistance request, at step 709. For example, if the assistance request is for optimization parameters, then the sensor data requirements may include current well data. In another example, if the assistance request is due to failure of the BHA, then the statistical service may determine that sensor data from the BHA and the drill string are required to correct the failure.

Based on the requirements, sensor data is obtained, at step 711. Multiple mechanisms exists which may be used to obtain sensor data without departing from the scope of the invention. Below are several examples of the type of sensor data that may be obtained.

In a first example, as sensor data is obtained from the sensors, the sensor data collectors may continually or periodically populate the data store with the sensor data. Thus, the data store may have the most current data available. To obtain the data, the remote system may query the data store with a request for the data complying with the sensor data requirements.

In another example, the remote system may send a request for the sensor data to the sensor data collectors. The request may or may not be routed through the rig operator's system. Further, the request may include the requirements for the sensor data. Specifically, a request may be sent to the sensor data collector to obtain sensor data that complies with the requirements, or the request may include information about such requirements. For example, if a particular vendor is responsible for the BHA, and the sensor data requirements require sensor data from the BHA, then the request may be sent only to the particular vendor. In turn, the sensor data collector may collect the sensor data and transmit the sensor data directly or indirectly (e.g., via the data store) to the remote system.

Continuing with FIG. 5, the sensor data is analyzed to identify the condition of the rig, at step 713. In particular, abnormal values may be identified. Additionally, trends in the values of the sensor data may be identified to determine potential failure and/or opportunities to optimize drilling.

Based on the assistance request and the condition of the rig, a determination is made whether an external service is required, at step 715. An external service may be required when the assistance request requires expertise which is prohibitive, such as due to cost or capability, for the remote system to offer. For example, the external service may be for medical personnel, coast guard, or firefighters. Alternatively, the external service may be to correct a failure of the rig for which the expertise for the failure recovery is not available at the remote system.

If the external service is required, then the required external service is identified, at step 717. Further, the assistance provider or automated help service coordinates with the external service and the rig operator to provide assistance based on the condition of the rig, at step 719. The assistance provider or automated help service may also create a record of the communication with the external service and rig operator. The record may be saved, for example, in the data store, or sent to users who registered to be notified of communications.

Figure 6:
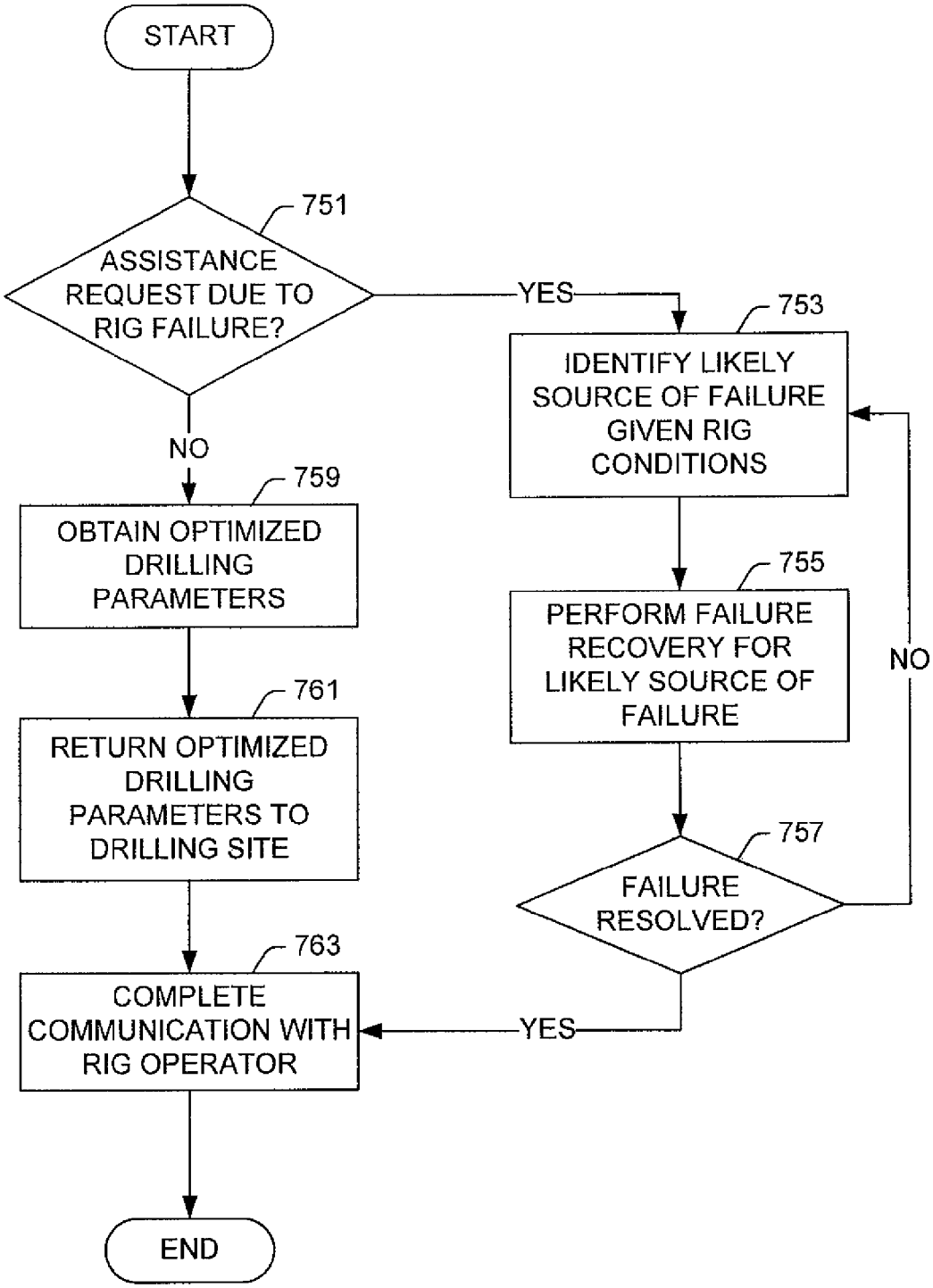
FIG. 6 shows a method in accordance with at least one embodiment of the invention.

Alternatively, if an external service is not required in step 715, the remote service provides assistance to the drilling site, at step 721. FIG. 6 shows a method for a remote service to provide assistance in accordance with at least one embodiment of the invention.

As shown in FIG. 6, a determination is made whether the request is due to rig failure, at step 751. If the request is due to rig failure, then the likely source of failure is determined based on the rig conditions, at step 753. For example, the statistical service may use the historical statistical data to determine the source of the failure given the environment and the condition of the rig. Alternatively, an assistance provider, such as an engineer, may view the conditions of the rig and use experience or other such tools to identify the likely source of failure.

Based on the likely source of failure, failure recovery is performed, at step 755. Performing the failure recovery may be remotely or via the rig operator. For example, the assistance provider may use a remote connection to the rig control unit to adjust parameters at the drill site. Alternatively, the assistance provider, or automatic help service, may guide the rig operator through a series of steps of the failure recovery.

Once the failure recovery is complete, a determination is made whether the failure is resolved, at step 757. If the failure is not resolved, then the assistance provider, or automated help service, may determine whether another mechanism exists to recover from the failure, or determine whether a different potential source of failure may be the cause of the failure. In such scenario, the method may repeat with step 753 or 755. One skilled in the art will appreciate that determining the likely source of failure and the failure recovery may require additional sensor data. Accordingly, at virtually any stage, additional sensor data may be obtained. When the failure is resolved, the communication with the rig operator is complete, at step 763.

Alternatively, if in step 751, the assistance request is not due to rig failure, the assistance request may be for optimized drilling parameters. Accordingly, optimized drilling parameters are obtained, at step 759. The optimized drilling parameters may be obtained according to the method described below and in FIG. 7 and FIG. 8 in accordance with at least one embodiment of the invention.

Once the optimized drilling parameters are obtained, the optimized drilling parameters are returned to the drilling site, at step 761. Returning the optimized drilling parameters may be performed, for example, by populating a data store with the optimized drilling parameters, informing the rig operator of the optimized drilling parameters, remotely updating the rig control unit with the optimized drilling parameters, etc.

Further, communication with the rig operator is completed, at step 763. At this stage, the channel of communication between the quick-link communication device and the remote system may be disconnected.

Figure 7:
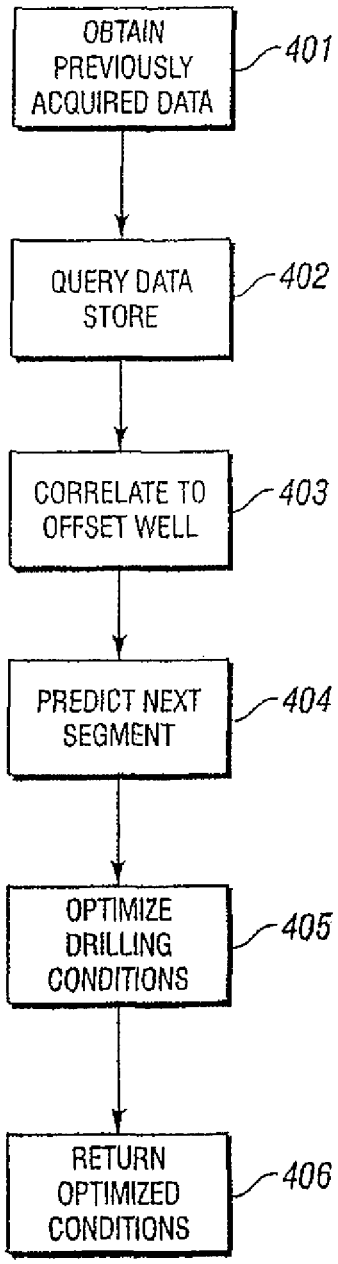
FIG. 7 shows a method in accordance with at least one embodiment of the invention.

FIG. 7 shows a method in accordance with the invention for optimizing drilling parameters in real time. In one or more embodiments, the method is performed by a drilling optimization service. One such service, called DBOS™, is offered by Smith International, Inc., the assignee of the entire right in the present application. A method for optimizing drilling parameters may be performed at a location that is remote from the drilling site. A remote data store may also be at any location. It is within the scope of the invention for a data store to be located at the drilling site or at the same location where the method for optimizing drilling parameters is being performed. In some embodiments, the data store is remote from at least one, if not both, of the drilling site and the location of the drilling parameter optimization.

The method includes obtaining previously acquired data, at step 401. In some embodiments, the previously acquired data is known before the current well is drilled. Thus, the data may be provided to a drilling optimization service before the current well is drilled. In other embodiments, the previously acquired data may be stored in the data store, and the previously acquired data may be queried from the data store—either separately or together with the current well data.

The method includes querying the data store to get the current well data, at step 402. In some embodiments, querying the current well data includes obtaining all of the data that is available for the current well. In other embodiments, querying the current well data includes obtaining only certain of the data that is specifically desired.

The current well data that is queried may include any data related to the current well, the formations through which the current well passes and their contents, as well as data related to the drill bit and other drilling conditions. For example, current well data may include the type, design, and size of the drill bit that is being used to drill the well. Current well data may also include rig sensed data, LWD/MWD data, and any lagged data that has been obtained.

It is noted that the current well data may not include data related to all of the properties and sensors mentioned in this disclosure. In practice, the instruments and sensors used in connection with drilling a well are selected based on a number of different factors. It is generally impracticable to use all of the sensors mentioned in this disclosure while drilling a well. In addition, even though certain instruments may be included in a BHA, for example, the data may not be available. This may occur because certain other data are deemed more important, and the available telemetry bandwidth is used to transmit only selected data.

It is also noted that a particular method for optimizing drill bit parameters may be performed multiple times during the drilling of a well. One particular instance of querying the data store for the current well data may yield updated or new data for a particular part of the formation that has already been drilled. This will enable the current optimization method to account for previous drilling conditions, as will be explained, even though those conditions were not previously known.

FIG. 7 shows three separate steps for correlating the current well data to the previously acquired data (at 403), predicting the next segment (at 404), and optimizing drilling parameters (405). Each of these will be described separately, but it is noted that in some embodiments, these steps may be performed simultaneously. For example, an ANN, as will be described, may be trained to optimize the drilling parameters using only previously acquired data and current well data as inputs. In this regard, the "steps" may be performed simultaneously by a computer with an installed trained ANN. Although this description and FIG. 7 include three separate "steps," the invention is not intended to be so limited. This format for the description is used only for ease of understanding. Those having skill in the art will appreciate that a computer may be programmed to perform multiple "steps" at one time.

The method may next include correlating the current well data to previously acquired data, at step 403. There is, in general, a correspondence between the subterranean formations traversed by one well and that of a nearby well. A comparison or correlation of the current well data to that of an offset well (or other well drilled in the same area or a geographically similar area) may enable a determination of the position of the drill bit relative to the various structures and formations. In addition, the data from nearby wells, or wells in geologically similar areas, may provide information about the characteristics and properties of the formation rock.

A correlation of current well data to previously acquired data may include a determination of the formation properties of the current well. The current well formation properties may then be compared and correlated to the known formation properties from an offset well (or other well). It is noted that these properties may be determined from analysis of the previously acquired data. By identifying the relative position in the offset well that corresponds to the properties of the current well at a particular position, the relative position in the current well with respect to formation boundaries and structures may be determined. It is noted that formation boundaries and other structures often have changing elevations. A formation boundary in one well may not occur at the same elevation as the same boundary in a nearby well. Thus, the correlation is performed to determine the relative position in the current well with respect to the boundaries and structures.

In some embodiments, the current well data is analyzed by other parties, such as third party users and vendors. The other parties may determine the formation properties in the current well, and that information may be uploaded to the data store. In this case, the optimization method need not specifically include determining the formation properties.

In some embodiments, the formation properties are not specifically determined at all. Instead, the raw measurement data from the current well may be compared to similar data from the previously acquired data. In this aspect, the relative position in the current well may be determined without specifically determining the formation properties of the current well.

In some embodiments, a fitting algorithm may be used to correlate the current well data to the previously acquired data. Fitting algorithms are known in the art. In addition, a fitting algorithm may include using an error function. An error function, as is known in the art, will enable finding the correlation that provides the smallest differences between the current well data and the previously acquired data.

In some embodiments, correlating the current well data to previously acquired data may be performed by a trained ANN. For example, determining the physical properties of an Earth formation using an ANN is described in the '919 patent (U.S. Pat. No. 6,424,919, described in the Background section, and incorporated by reference in its entirety). In general, training an ANN includes providing the ANN with a training data set. A training data set includes known input variables and known output variables that correspond to the input variables. The ANN then builds a series of neural interconnects and weighted links between the input variables and the output variables. Using this training experience, an ANN may then predict unknown output variables based on a set of input variables.

To train the ANN to determine formation properties, a training data set may include known input variables (representing well data, e.g., previously acquired data) and known output variables (representing the formation properties corresponding to the well data). After training, an ANN may be used to determine unknown formation properties based on measured well data. For example, raw current well data may be input to a computer with a trained ANN. Then, using the trained ANN and the current well data, the computer may output estimations of the formation properties.

Further, it is noted that although correlating current well data to previously acquired data may be done entirely by a computer, in certain embodiments, it may also include human input. For example, a human may check a particular correlation to be sure that a computer (possibly including an ANN) has not made an error that would be immediately identifiable to a person skilled in the art. If such an error is made, an optimization method operator may intervene to correct the error.

The method may next include predicting the drilling conditions for the next segment, at step 404. Based on the correlation of the current well data to the previously acquired data, a prediction is made about the nature of the formation to be drilled—that is, the formation in front of the drill bit. In some cases, this may include a prediction that the characteristics of the formation to be drilled are not changing. In other cases, the prediction may include a change in formation or rock characteristics for the next segment.

Possible changes in formation or rock characteristics include changes in the rock compressive strength or shear strength, or changes on other rock mechanical properties. These changes may result from crossing a formation layer boundary. For example, a drill bit that is currently drilling through sandstone may be predicted to cross a formation boundary in the next segment so that the drill bit will then be drilling shale or limestone. When the drill bit crosses a formation layer boundary, the new type of rock will generally have different mechanical properties requiring different drilling parameters to be used for an optimal condition.

In some embodiments, predicting the formation properties for the next segment includes predicting the formation properties for the remainder of the planned well (i.e., to the planned depth). The prediction of the formation properties of the next segment are used to then predict the formation properties for the following segment. In this manner, the formation properties for the remainder of the run may be predicted.

In some embodiments, the previous prediction of formation properties for the next segment, or for any previously optimized segment, may be updated based on current well data that was not available when the previous prediction was made. For example, a prediction about the formation properties for the next segment may be made without the benefit of lagged data or of data obtained using a wireline tool. In a subsequent performance of the method, such data may be available for previously drilled sections of the well. The newly available data may be used to update previous optimizations so that a better optimization for the next segment may be obtained.

It is noted that the prediction of the formation properties for the next segment may be verified by subsequent LWD/MWD data, or other vendor data. When subsequent measurements confirm the prediction, this increases the confidence in the optimization result. First, it increases the confidence in the correlation of the current well data to the previously acquired well. Second, it provides confidence that the prediction of the formation properties for the next segment is also accurate. In the event that the measurements do not confirm the prediction, the optimization method may be performed again, or human intervention may be required. In addition, non-confirming subsequent measurements may indicate an anomalous downhole situation that may require special action by the driller.

Predicting the formation properties may be done using a trained ANN. In such embodiments, the ANN may be trained using a training data set that includes the previously acquired data and the correlation of well data to offset well data as the inputs and known next segment formation properties as the outputs. Using the training data set, the ANN may build a series of neural interconnects and weighted links between the input variables and the output variables. Using this training experience, an ANN may then predict unknown formation properties for the next segment based on inputs of previously acquired data and the correlation of the current well data to the previously acquired data.

Next, the method may include optimizing drilling parameters, at step 405. The optimal drilling parameters are determined for drilling the next segment, based on the drill bit being used and the predicted formation properties of the next segment. Once determined, the optimal drilling parameters may be uploaded to the data store so that they are available to rig personnel and other parties needing the information. In some embodiments, as will be explained, an automated drilling control system queries the data store for the optimal drilling parameters and controls the drilling process accordingly.

The optimized parameters are recommended drilling parameters for drilling the next segment. Such parameters may include WOB, TOB, RPM, mud flow rate, mud density, and any other drilling parameter that is controlled by a driller. In some embodiments, the drilling parameters are optimized for the current drill bit. In other embodiments, the optimized parameters may include a recommendation to change the drill bit for the next segment. A drastic change in formation type may require a different type of drill bit for the best optimization of the drilling parameters. This process is also addressed in the '919 patent.

Determining the optimized parameters may be based on one or more drilling priorities. For example, in one embodiment, the drilling parameters are optimized to drill the well in the most economical way. This may include balancing the life of the bit with maximizing the ROP. In one particular embodiment, this includes determining an ellipse representing acceptable values for bit life and ROP, and the drilling parameters are selected so that the bit life and ROP fall in the ellipse.

Other examples of priorities that may be used for optimizing drilling parameters include reducing vibration, as well as directional plan and target considerations. Vibration may be very harmful to a drill bit. In extreme cases, vibration may cause premature catastrophic failure of the drill bit. If vibration is detected or predicted, the drilling parameters may be optimized to reduce the vibration, even though the vibration-optimized parameters may not produce the most economically drilled well or segment. Also, if the directional plan calls for a specified build angle to reach a particular underground target, such a priority may take precedence over economic or ROP considerations. In such a case, the drilling parameters may be optimized to maintain the desired well trajectory.

It may be possible that LWD/MWD measurements reveal that the planned target may not be in the location where it was thought to be. In such a case, the target may be revised during the drilling process. In such a case, the optimization method may devise a new optimal directional plan and account for the new direction plan in the drilling priorities. In other cases, a new directional plan may be uploaded to the data store for use in the optimization method.

In some embodiments, optimizing drilling parameters includes predicting a "dulling off" of the drill bit. The amount of drill bit dulling that has already occurred will affect the way the drill bit drills the next segment, and the amount of dulling may have an affect on the optimized parameters. The amount of drill bit dulling that has occurred may be estimated based on current well data for those portions of the formation that have already been drilled, as well as data related to such things as WOB, TOB, RPM, mud flowrate, drilling pressure, and data related to measurements of the drill bit properties while drilling. In addition, the optimization may include predicting the level of drill bit dulling that will occur while drilling the next segment. In addition, after tripping the drill string, the amount of dulling may be specified or reset following an inspection or replacement of the drill bit.

Further, in some embodiments, optimizing drilling parameters for the remainder of a bit run may include predicting the dulling off that will occur if the segments to be drilled are drilled using the optimized parameters. This may include optimizing the drilling parameters for a future segment based on the dulling off of the drill bit that is predicted to occur in drilling to that segment. In some embodiments, the prediction of dulling off is revised based on drilling parameters that are actually used, in the event that the actual drilling parameters for a particular segment vary from the optimized values for that segment.

In addition to predicting the dulling that has occurred, and optimization method may include predicting the hours of bit life remaining. This may be accomplished by predicting how the drill bit will wear while drilling the next segment, and other future segments, using the optimized drilling parameters. This may also enable the determination of the depth at which the drill bit will wear out or fail, if that may occur before the drill bit reached the target or planned depth.

In some embodiments, a method for optimizing drilling parameters include predicting optimized parameters for the entire run of the drill bit to the planned depth. The method may include consideration of predicted formation properties for the entire run based on correlations of the current well data to previously acquired data.

In still further embodiment, the method may include consideration of lagged or delayed data that was not previously available. The estimation of drill bit dulling and the optimization of drilling parameters may be re-performed based on the newly available data.

Optimizing the drilling parameters 405 may include the use of a trained ANN. In such embodiments, the ANN may be trained using a training data set that includes the known formation properties, drill bit properties, and drilling priorities as the inputs and known optimal parameters as the training outputs. Using the training data set, the ANN may build a series of neural interconnects and weighted links between the input variables and the output variables. Using this training experience, an ANN may then predict the optimized drilling properties for the next segment based on inputs of the predicted formation properties for the next segment of the current well, the drill bit properties, and the current well drilling priorities.

As was mentioned above, a computer having a trained ANN installed thereon may be used to perform the correlation to previously acquired data, prediction of next segment properties, and drilling condition optimization. These "steps" may be performed by a computer, using one or more ANNs to determine the optimized drilling parameters. The current well data and the previously acquired data may be input into the computer or ANN, and the outputs would be the optimized drilling parameters for the next segment.

In some embodiments, the ANN, or separate ANNs, may be trained to perform individual steps. In at least one embodiment, an ANN is trained to make the neural interconnections and weighted links for the entire optimizing operation.

Finally, the method may include uploading the optimized parameters to the data store, at step 406. Once a particular optimization method is performed, the optimized parameters may be uploaded to the data store so that the optimized parameters are available to personnel, computers, and "smart" tools with processor capabilities at the drilling site. In some embodiments, the optimized parameters include recommended changes to be made immediately. In other embodiments, the optimized parameters include a position or depth at which the optimized parameters should be implemented. This may represent, for example, a prediction that the drill bit will encounter a formation boundary at a specific position, and the parameters are optimized for the segment of the well to be drilled at or beyond the formation boundary.

In some embodiments, the uploaded data represents the optimized drilling parameters for the remainder of the run to the planned depth, or some segment thereof. In some other embodiments, the uploaded parameters may be revised from a previous optimization to planned depth based on newly available data.

The method may include using an automated drilling system to control the drilling process. In that case, the automated drilling system may query the data store for the optimized drilling parameters and control the drilling accordingly. A typical automated drilling system uses servos and other actuators to operate conventional drilling control. It is usually done this way so that a driller may take over the process by disengaging the automated system and operating the control in the conventional way. However, other automated systems, for example computer control of the entire process, may be used without departing from the scope of the present invention.

Figure 8:
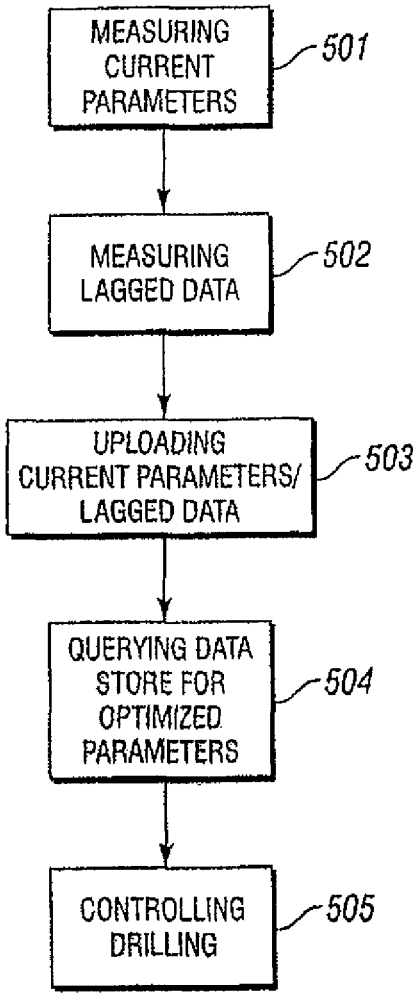
FIG. 8 shows a method in accordance with at least one embodiment of the invention.

FIG. 8 shows a method of drilling, in accordance with one aspect of the invention. The method first includes measuring current drilling parameters, at 501. This is the rig-sensed data, including WOB, TOB, RPM, etc. In some embodiments, the method also includes measuring the lagged data, such as return mud analysis, at 502. This step may not be included in all embodiments.

The method includes uploading the current parameters and the lagged data to a remote data store, at 503. The data may then be queried from the remote data store for analysis by a drilling optimization service. The method may also include querying the remote data store for a set of optimized drilling parameters for the next segment, at 504. In some embodiments, the optimized parameters are returned to the data store by a drilling optimization service. In some cases, querying the remote data store for the optimized parameters include querying the optimized parameters for the remainder of the run to the target depth.

The method may then include controlling the drilling in accordance with the optimized drilling parameters, at 505. In some embodiments, this is performed by a driller. In other embodiments, the drilling is performed by an automated drilling system, and controlling the drilling in accordance with the optimized parameters is performed by the automated drilling system.

Portions of embodiments of the invention may be implemented on virtually any type of computer regardless of the platform being used. For example, a computer system includes a processor, associated memory, a storage device, and numerous other elements and functionalities typical of computers. The computer may also include input means, such as a keyboard and a mouse, and output means, such as a monitor. The computer system may be connected to a network via a network interface connection. Those skilled in the art will appreciate that these input and output means may take other forms.

Further, those skilled in the art will appreciate that one or more elements of the aforementioned computer system may be located at a remote location and connected to the other elements over a network. Further, the invention may be implemented on a distributed system having a plurality of nodes, where different portions of the invention (e.g., event monitor, engineer's communication unit, rig analysis tool, data store, etc.) may be located on a different node within the distributed system. Further, the same portion of the invention, such as the data store, may be distributed across multiple nodes. In one embodiment of the invention, the node corresponds to a computer system. Alternatively, the node may correspond to a processor with associated physical memory. The node may alternatively correspond to a processor with shared memory and/or resources. Further, software instructions to perform embodiments of the invention may be stored on a computer readable medium such as a compact disc (CD), a diskette, a tape, a file, or any other computer readable storage device.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for providing assistance to a drilling site during a drilling operation, comprising:

receiving, during the drilling operation, by a remote system remote from the drilling site, an assistance request from a quick-link communication device of a rig operator's system located at the drilling site, wherein the quick-link communication device is a dedicated communication device configured to allow connections only to the remote system;

obtaining, during the drilling operation, sensor data through the quick-link communication device from a rig based on the assistance request;

analyzing, by the remote system and during the drilling operation, the sensor data to identify a condition of the rig during the drilling operation, wherein analyzing the sensor data comprises:

obtaining previously acquired data;

querying, during the drilling operation, a remote data store for current well data, wherein the current well data is comprised in the sensor data obtained during the drilling operation; and determining, during the drilling operation, optimized drilling parameters for a next segment, wherein the determining the optimized drilling parameters comprises:

correlating the current well data to the previously acquired data; predicting drilling conditions for the next segment; and optimizing drilling parameters for the next segment during the drilling operation, and providing assistance to the drilling site for the condition of the rig during the drilling operation wherein providing assistance to the drilling site for the condition comprises:

identifying a potential cause of failure given the condition;

returning optimized parameters for the next segment to the remote data store; and providing, during the drilling operation, instructions for drilling the next segment based on the optimized parameters to the rig operator's system.

2. The method of claim 1, wherein the assistance request is for obtaining optimized drilling parameters.

3. The method of claim 1, further comprising:

providing general information to the drilling site.

4. The method of claim 1, wherein providing assistance to the drilling site comprises:

coordinating with an external service.

5. The method of claim 1, wherein providing assistance to the drilling site further comprises:

performing failure recovery for the potential cause of failure.

6. The method of claim 5, wherein identifying the likely source of failure comprises:

obtaining previously acquired data based on the condition and an environment of the rig; and analyzing the previously acquired data for the likely source of failure.

7. The method of claim 1, wherein obtaining the sensor data comprises:

identifying sensor data requirements based on the assistance request;

requesting the sensor data corresponding to the sensor data requirements from a sensor data collector; and querying a data store for the sensor data, wherein the sensor data collector populates the data store.

8. The method of claim 1, wherein the quick-link communication device comprises a speaker, a button, and a microphone.

9. The method of claim 1, wherein the sensor data comprises at least one selected from a group consisting of weather data, seismic activity data, fire detector data, and medical equipment data.

10. A system for providing assistance to a drilling site during a drilling operation, comprising:

a rig operator's system, located at the drilling site, having a quick-link communication device, wherein the quick-link communication device is a dedicated communication device configured to allow connections during the drilling operation only to a remote system, wherein the remote system is remote from the drilling site;

the remote system configured to:

receive, during the drilling operation, an assistance request from the dedicated quick-link communication device, wherein the assistance request is for obtaining optimized drilling parameters;

obtain, during the drilling operation, sensor data from the rig based on the assistance request;

analyze, during the drilling operation, the sensor data to identify a condition of the rig; and provide assistance during the drilling operation to the drilling site for the condition of the rig; and identify a potential cause of failure given the condition of the rig;

a remote data store located at the remote system, configured to:

receive sensor data during the drilling operation from at least one sensor data collector located at the drilling site; and transmit the sensor data during the drilling operation to an analysis tool located at the remote system, wherein the analysis tool analyzes the sensor data during the drilling operation by:

obtaining previously acquired data;

querying the remote data store for current well data, wherein the current well data is comprised in the sensor data; and determining optimized drilling parameters for a next segment, wherein determining the optimized drilling parameters comprises:

correlating the current well data to the previously acquired data;

predicting drilling conditions for the next segment;

optimizing drilling parameters for the next segment, wherein providing assistance to the drilling site for the condition comprises returning optimized parameters for the next segment to the remote data store; and provide instructions for drilling the next segment based on the optimized parameters to the rig operator's system.

11. The system of claim 10, further comprising: providing general information to the drilling site.

12. The system of claim 10, wherein providing assistance to the drilling site comprises:

coordinating with an external service.

13. The system of claim 10, further comprising an analysis tool configured to:

analyze the sensor data; and provide assistance to the drilling site by:

identifying a likely source of failure given the condition; and performing failure recovery for the likely source of failure.

14. The system of claim 13, wherein identifying the likely source of failure comprises:

obtaining previously acquired data based on the condition and an environment of the rig; and analyzing the previously acquired data for the likely source of failure.

15. The system of claim 10, wherein the quick-link communication device comprises a speaker, a button, and a microphone.

16. The system of claim 10, wherein the sensor data comprises at least one selected from a group consisting of weather data, seismic activity data, fire detector data, and medical equipment data.

* * * * *